United States Patent [19]

Ide

[11] Patent Number: 4,657,376

[45] Date of Patent: Apr. 14, 1987

[54] IMAGE FORMING APPARATUS IN WHICH AN IMAGE FORMING UNIT AND A DOCUMENT FEEDING UNIT ARE ALTERNATELY OPERATED

[75] Inventor: Fumito Ide, Zama, Japan

[73] Assignee: Kabushiki Kaisha Toshiba, Kawasaki, Japan

[21] Appl. No.: 786,010

[22] Filed: Oct. 10, 1985

[30] Foreign Application Priority Data

Oct. 17, 1984 [JP] Japan ..... 59-217809

[51] Int. Cl.[4] ..... G03G 15/00

[52] U.S. Cl. ..... 355/14 R; 355/14 C

[58] Field of Search ..... 355/14 R, 14 C, 14 SH, 355/3 R; 364/131, 133

[56] References Cited

U.S. PATENT DOCUMENTS 4,235,550 11/1980 Case ..... 355/14 R 4,426,150 1/1984 Matsumoto et al. ..... 355/14 R X

OTHER PUBLICATIONS

*Microprocessors and Microsystems,* vol. 3, No. 6, Jul.-/Aug. 1979, "Discus-a Distributed Control Microprocessor System", pp. 267-270.

*Primary Examiner*—A. T. Grimley

*Assistant Examiner*—J. Pendegrass

*Attorney, Agent, or Firm*—Cushman, Darby & Cushman

[57] ABSTRACT

An image forming apparatus reciprocally operates one of the image forming body units and the document feeding units. A first control circuit produces signals necessary for image formation operation, while keeping an automatic document feeder in a wait state. A second control circuit operates the automatic document feeder only when the image formation operation is not in progress. Therefore, the power source which is provided can be shared between the image forming body unit and the automatic document feeder without the necessity for excess capacity.

4 Claims, 10 Drawing Figures

IMAGE FORMING APPARATUS IN WHICH AN IMAGE FORMING UNIT AND A DOCUMENT FEEDING UNIT ARE ALTERNATELY OPERATED

BACKGROUND OF THE INVENTION

This invention relates to an image forming apparatus, and more particularly to a copy machine with a document feeder.

Many recent copy machines employ a document feeder for automatically feeding a document to the copy machine. Some copy machines use additionally provided power supplies for driving the associated document feeders, while other copy machines drive their document feeders by means of, the power supplies provided for driving the copy machine. The former case is disadvantageous in size, weight, and cost. The later case requires a large power capacity because it must drive both the copy machine and the document feeder.

SUMMARY OF THE INVENTION

It is, therefore, an object of the present invention to provide a small, light and inexpensive image forming apparatus which requires neither an increased power capacity of the power supply for the image forming body, nor an additional, and, more precisely, simultaneous use of another power supply for a document feeder.

To this end, the document feeder is operated only when the image forming body is not operated.

According to the present invention, an image forming apparatus with an automatic document feeder that uses a reciprocal supervisor is provided. A document table is provided on which a document to be copied is set upon. An image forming body unit includes optical means for optically scanning the document to be copied. Image forming means forms the document image on an image formation medium, and fixing means fixes this document image onto the formation medium.

An automatic document feeder is also provided which has an insertion section through which the document to be copied is inserted. A first detector means detects an insertion of this document to be copied therein. First conveying means then conveys this inserted document to a predetermined position on the document table. A second detector means detects this operation. Discharging means is provided for discharging the document conveyed by the first conveying means, and second conveying means is provided to convey the document to the discharging means.

Means is also provided to instruct an image formation.

A first control means supplies a first sequence control signal to the image forming body unit and simultaneously generates a wait instruction commanding the document feeder to a wait state. A second control means produces a second sequence control signal which is necessary for the document conveying operation, and is responsive to the wait signal produced by the first control means. Therefore, while the image formationn operation is in progress, the document feeder is in a wait state, and while the document feeder is operating, the image formation unit is in a wait state. Therefore, the power source which is provided can be shared between the image forming body unit and the automatic document feeder due to the time sharing operation therebetween.

BRIEF DESCRIPTION OF THE DRAWINGS

These and other objects and features of the present invention can be understood by reference to the accompanying drawings, in which:

FIGS. 6A, 6B-1, 6B-2 and 6C show flowcharts charting the flow of the operation of the document feeder used in the copy machine of FIG. 1.

DETAILED DESCRIPTION OF THE PREFERRED EMBODIMENT

A preferred embodiment of an image forming apparatus according to the present invention will be described referring to the accompanying drawings. A typical example of the image forming apparatus according to the present invention is a familiar and popular copy machine. Such a copy machine will be used as a means of describing the present invention.

Figure 1:
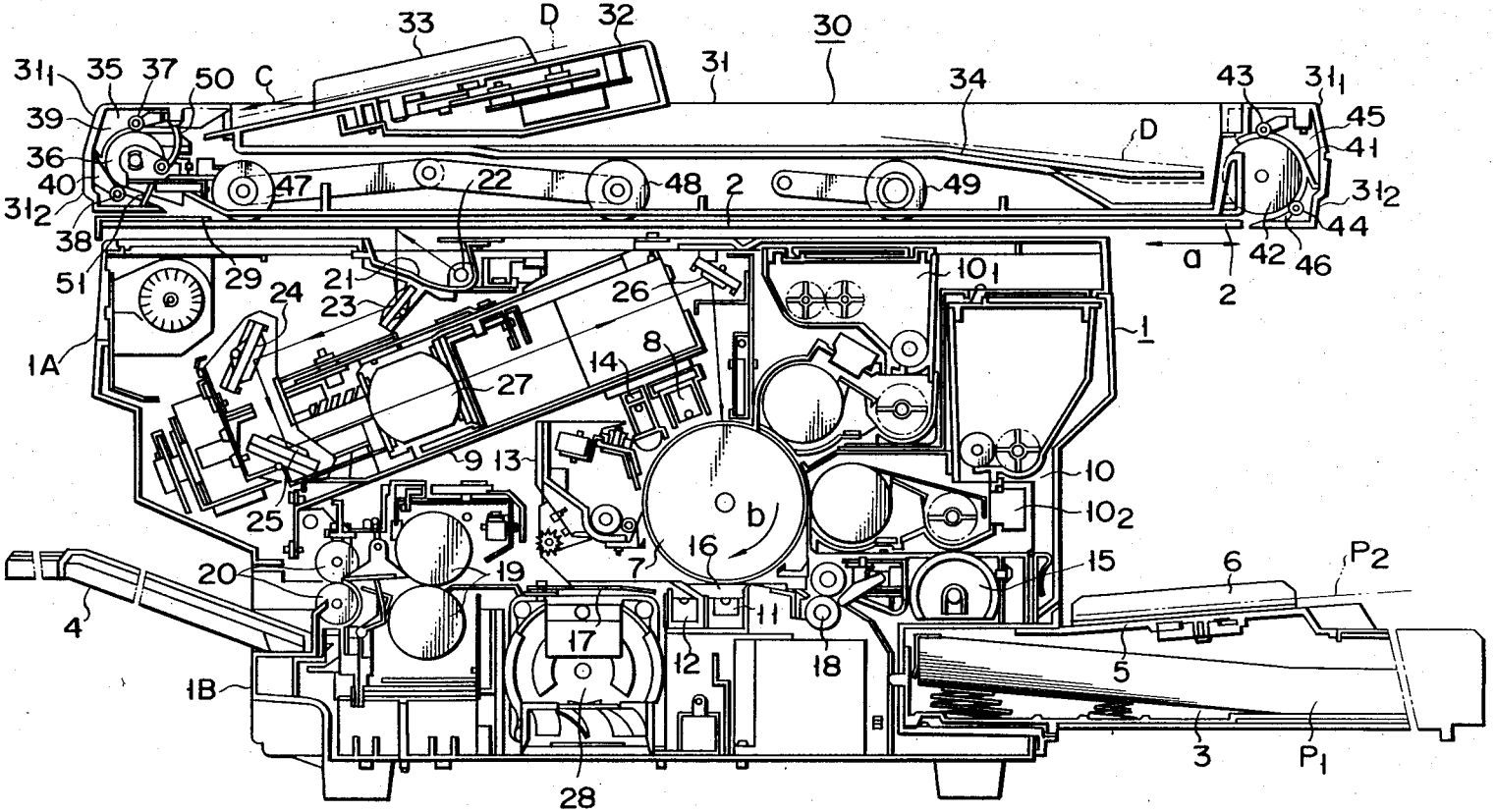
FIG. 1 shows a longitudinal sectional view of a copy machine in which the present invention is applied.

FIG. 1 shows a copy machine of the table moving type which is provided with a document feeder. In the figure, a document table 2 is set on a top side of the main body 1 of the copy machine. This document table 2 is reciprocatively movable in the directions indicated by arrows a. A document feeder 30 covering the upper side of the document table 2 is hingedly mounted on the document table 2. (The document feeder 30 will be described later in detail.) The construction of the main body 1 of the copy machine will be described below. As shown, a paper cassette 3 is set to the right side of the main body 1, while a paper discharging tray 4 is set to the left side thereof. A cassette cover 5 for the cassette 3 serves as a manual feed table 6 for manually feeding paper P2 when required.

A photosensitive drum 7 is disposed at substantially the center of the main body 1. A charging charger 8, an optical system 9, a two-color developer 10, a transfer charger 11, a discharging charger 12, a cleaner 13 and a quenching lamp 14 and the like are successively disposed around the photosensitive drum 7. The two-color developer 10 consists of a first developer $10_1$ and a second developer $10_2$ which are removably mounted on the main body 1. The first developer $10_1$ or the second developer $10_2$ is selectively driven to make a color development of black or another color of, for example, red, yellow, blue or green. A transport path 17 is laid in the underpart of the main body 1. The transport path 17 guides either a paper P1 automatically taken out of the cassette 3 by a feed roller 15 or a paper P2 inserted by a manual feed table 6 to the discharging tray 4 through an image forming section 16 located between the photosensitive drum 7 and the transfer charger 11. A resist roller 18 is disposed upstream of the image forming section 16 on the transport path 17, and a heat roller 19, as a fusing device, and an exit roller 20 are disposed downstream of the transport path 17.

The optical system 9 includes an exposure lamp 22 of which the rear is covered with a reflector 21, mirrors 23 to 26, and a lens 27 which is positioned according to a set magnification.

The photosensitive drum 7 is driven in the b direction by a drive mechanism (not shown), in synchronism with the document table 2. In operation, the photosensitive drum 7 is uniformly charged by the charger 8. A document is uniformly illuminated by the exposure lamp 22 and imaged, by the optical system 9, in the form of a latent image on the uniformly charged drum 7. The latent image is developed by the two-color developer 10 into a toner image, and is transported to a transfer charger 11. The paper P1 or P2, as automatically or manually fed, is registered and transferred forward by the resist roller 18. Then, the toner image already formed on the drum 7 is transferred to the paper by a transfer charger 11. The paper P1 (P2) bearing the toner image is picked off of the photosensitive drum 7 by means of the pick-off charger 12 and then led to the heat roller 19 through the transport path 17. At the heat roller 19, the toner image is fused to the paper. The paper with the image fused thereon is discharged to the discharging tray 4 by the exit roller 20. After the transfer of the developed image to the paper P1 (P2), toners remaining on the drum surface are removed by a cleaner 13. The image left on the photosensitive drum 7 is quenched by the lamp 14, and the apparatus is then ready for the next copy operation.

In the main body 1, the upper and lower frames are hinged at one end. The other ends of the upper and lower frames are openable at a desired angle of, for example, about 30°. The charger 8, the optical system 9, the exposure lamp 22, the two-color developer 10, the cleaner 13, the quenching lamp 14 and the like are fixed to the upper frame by suitable means, and are disposed around the drum. The document table 2 and the feed roller 15 are also mounted to the upper frame. The upper frame containing these devices forms the upper unit 1A. The many copying operation related devices such as the cassette 3, the transfer charger 11, the pick-off charger 12, the heat roller 19, the exit roller 20, the discharging tray 4, and the like, as well as the main motor are mounted on the lower frame. The lower frame containing these devices forms the lower unit 1B. After the front cover is turned and removed from the main body 1, the upper and lower units are opened, one from the other, along the paper P1(P2) transport path 17 by means of a frame opener (not shown).

A stopper 29 is for stopping, at a predetermined position, the document as fed by the document feeder 30. The stopper 29 is mounted to the left end of the document table 2 as viewed in the drawing.

The construction of the document feeder 30 will be described herein. A frame 31 is openably mounted onto the document table 2. The frame 31 has a size comparable with the document table 2 and is flat in shape. Structurally, it consists of the upper cover $31_1$ and the lower cover $31_2$, which are separably coupled to each other. Disposed above the housing 31 at the center is the document feeder 32 for feeding the document D in the direction of arrow c. The document feeder 32 is mounted on the upper cover $31_1$, and, as shown in the drawings, is slanted to the left. A pair of document guides 33 and 33 (only one of which is illustrated) are provided on the document feeder 32. These guides 33 and 33 are slidable, according to the width of the document D, in a direction orthogonal to the document feeding direction c. Below the document feeder 32, but above the housing 31, a tray serving as both the document discharging tray 34 and the upper cover $31_1$ is formed.

Disposed at one end of the inside of the housing 31 (at the left end as viewed in the drawing) is a document turn section 35 for turning in which can both turn a document in terms of its direction and locate the document D at a predetermined position on the document table 2. The document turn section 35 is comprised of a turn roller 36 for carrying the document D in a nipping manner, subrollers 37 and 38 rotatably contacting the turn roller 36, guide ribs 39 and 40 provided around the turn roller 36 and serving as a document feed guide, and the like. The guide rib 39 is mounted to the upper cover $31_1$, while the subroller 38, which is mounted to the lower cover $31_2$, holds the subroller 38. The turn roller 36 is mounted to the lower cover $31_2$.

Provided at the other end of the inside of the housing 31 is a document exit turn section 41 which can turn a document in terms of its direction and discharge the document D coming from the predetermined position on the document table 2 into the document discharging tray 34. The document exit turn section 41 is comprised of a turn roller 42 for carrying the document D in a nipping manner, subrollers 43 and 44 rotatably contacting the turn roller 42, guide ribs 45 and 46 provided around the turn roller 42 and serving as the document feed guide, and the like. The guide rib 45 is mounted to the upper cover $31_1$, while the guide rib 46, which is mounted to the lower cover $31_2$, holds the subroller 44. The turn roller 42 is mounted to the lower cover $31_2$. Between the document feed turn section 35 in the lower cover $31_2$ of the housing 31 and the document exit turn section 41, there are separately disposed feed rollers 47 to 49 for feeding the document D. These rollers 47 to 49 are rotatably in contact with the upper surface of the document table 2. The turn rollers 36 and 42 and the feed rollers 47 to 49 are driven by a motor (not shown) through a power transmission means (not shown). With such a structure, the transport path of the document D is formed in the shape of a loop.

In the document feed turn section 35, there are provided a first detector 50 for detecting the document D inserted from the document feeder 32 and a second detector 51 for detecting the length of the document D and the transport of the document D. The first detector 50 includes, for example, a detector lever and a microswitch. Similarly, the second detector 51 includes a detector lever and a microswitch. The first detector 50 is provided at the inlet of the turn roller 36. The second detector 51 is provided at the outlet of the turn roller 36.

The operation of the document feeder 30 thus constructed will be described. The document D is placed on the document feeder 32 with its picture or printed surface facing up, and is inserted in the direction of arrow c. Then, the document D is guided by the guide ribs 39 and 40, and pulled into the turn roller 36 and the subrollers 37 and 38. It is then turned and fed onto the document table 2. The document D on the document table 2 is transported on the document table 2 by the combination of the feed rollers 47 to 49. When the document D advances and passes the document stopper 29, and its trailing edge reaches a position forward of and distanced from the stopper 29 by a predetermined distance, it is temporarily stopped there. Then, the feed rollers 47 to 49 are reversely rotated to back-feed the document D toward the stopper 29. When the trailing edge of the document D contacts the stopper 29, the document D is stopped thereat. At this time, the document D is inverted with its image side facing down. This state indicates that the document D has been set at a predetermined position (stop position) on the document table 2. Then, the document table 2 bearing the document D thus set is moved, so that the document D is optically scanned.

The exit operation of the document D follows. With the forward rotation of the rollers 47 to 49, the document D, as has been stopped at the predetermined position on the document table 2, is fed toward the exit side and guided to the turn roller 42. The document D is further guided by the guide ribs 45 and 46, and is turned with the assistance of the turn roller 42 and the subrollers 43 and 44. It is then discharged into the document discharging tray 34 such that its image bearing surface faces upward.

Figure 2:
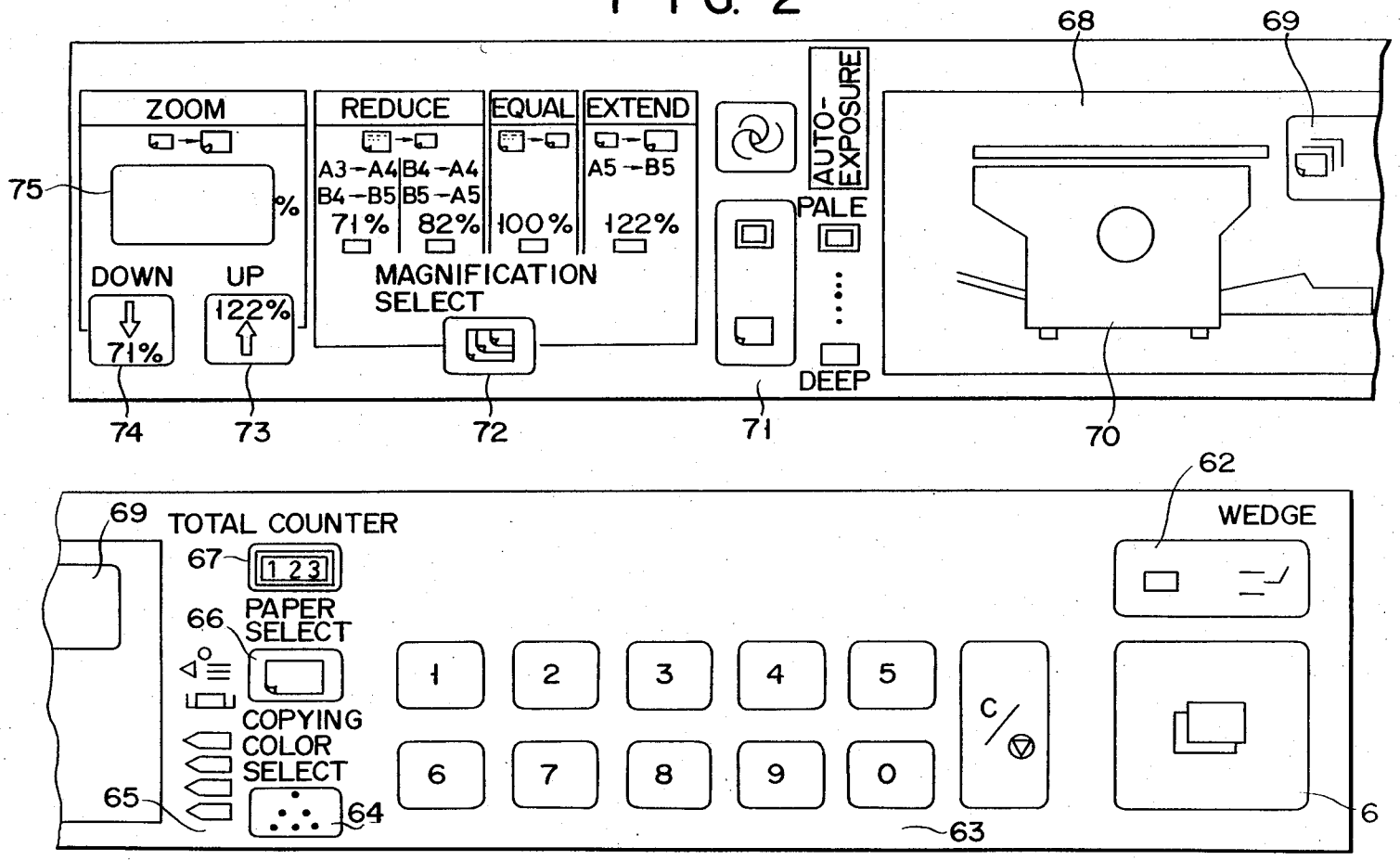
FIG. 2 shows an operation panel used in the embodiment of FIG. 1.

Turning now to FIG. 2, there is an operation panel set in a predetermined location of the main body 1 of the copy machine. The start key 61 is for starting the copy operation of the copy machine. The wedge key 62, when pushed, designates a wedge mode for wedge copying. Ten keys 63 are used in total for setting a desired number of copies. The color select key 64 selects a desired color of copy from a selection of colors including, for example, black, red, blue and green. The selected color is indicated by a color indicator 65. The auto/manual key 66 selects either the auto or manual paper feed mode. The total counter 67 counts the total number of copies. Reference numeral 68 designates a liquid crystal display including a number display 69 for displaying the number of copies, and a state display 70 for displaying the state of the copying operation. The density setter 71 sets a desired copy density, as can be selected from a density range of from pale to deep. The magnification select key 72 selects one of a number of predetermined magnifications. Magnification up and down keys 72 are for discretely setting a desired magnification. The magnification display 75 displays a magnification as set by the magnification setting keys.

Figure 3:
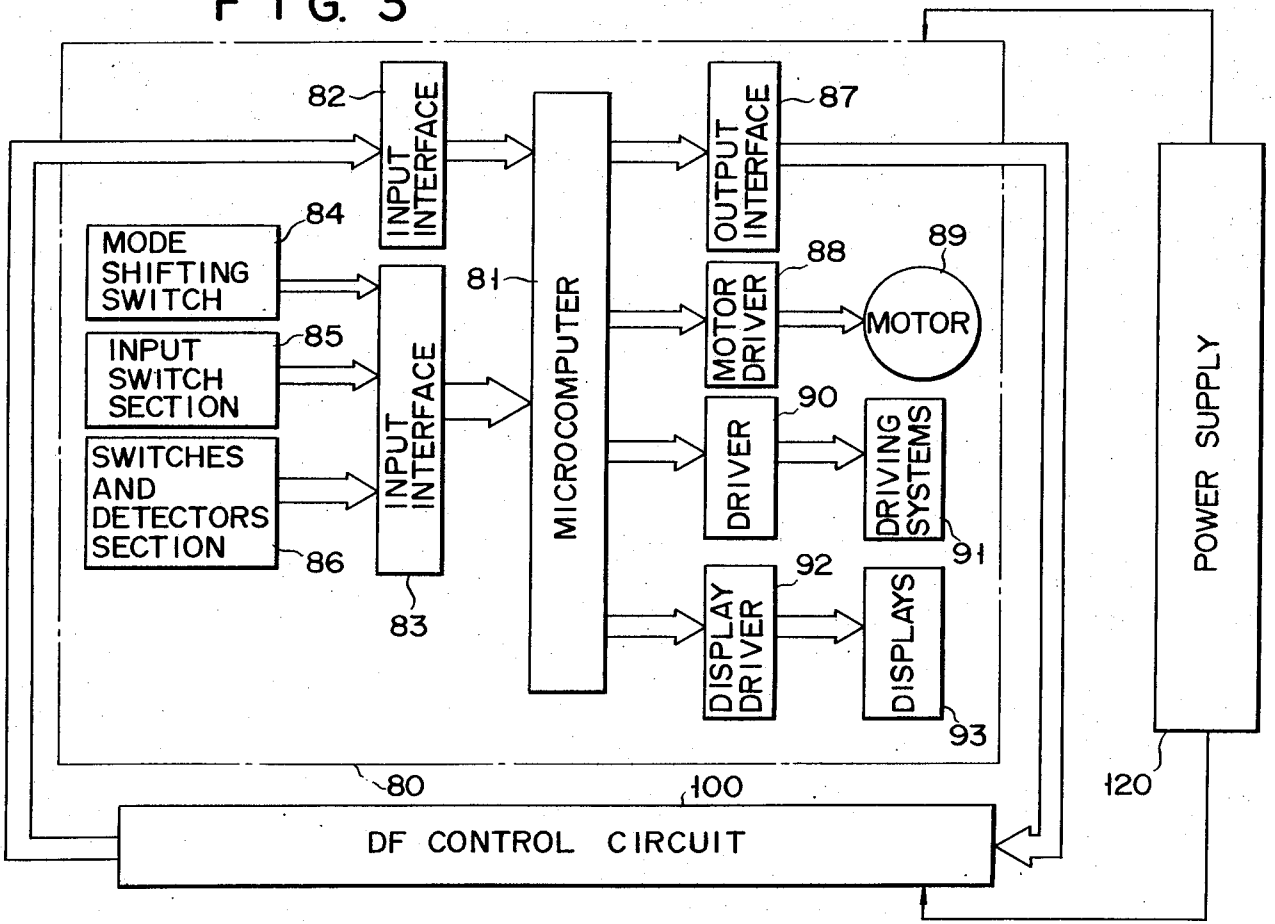
FIG. 3 shows a block diagram of a control circuit for controlling the operation of the main body of the copy machine of FIG. 1.

FIG. 3 shows, in block form, the main body control circuit 80 for controlling the main body 1 of the copy machine. The main body control circuit 80 is laid out on a printed circuit board mounted at an appropriate location in the main body 1. A microcomputer 81 controls the overall main body 1 of the copy machine. The microcomputer 81 receives a signal through an input interface 82 from a document feed (DF) control circuit 100 to be given later. The microcomputer 81 is connected through an input interface 83 such as a data selector to a mode shift key 84, an input switch section including many types of the keys 61 to 64 and 71 to 74 on the operation panel, and a switch/detector section 86 including switches and detectors necessary for other controls of the copy machine.

The mode, shift key 84 is used to place the copy machin into either an auto or a manual magnification select mode. The setting of the magnification select mode is made according to the request of a user when the copy machine is delivered to the user. For this reason, the mode shift key 84 is usually a dip switch mounted to the printed circuit board of the main body control circuit 80 in the main body 1. The microcomputer 81 transfers a signal to the DF control circuit 100 via an output interface 87, and a control signal to the lens motor 89, to set the magnification, through a motor driver 88. The lens motor 89 moves the lens 27. Further, the microcomputer 81 transfers control signals to a drive system 93 including the exposure lamp 22 and the motor 28 through a driver 90, and to a display system 93 including the liquid crystal display 68, the magnification indicator 75, and the like, through a display driver 92.

Figure 4:
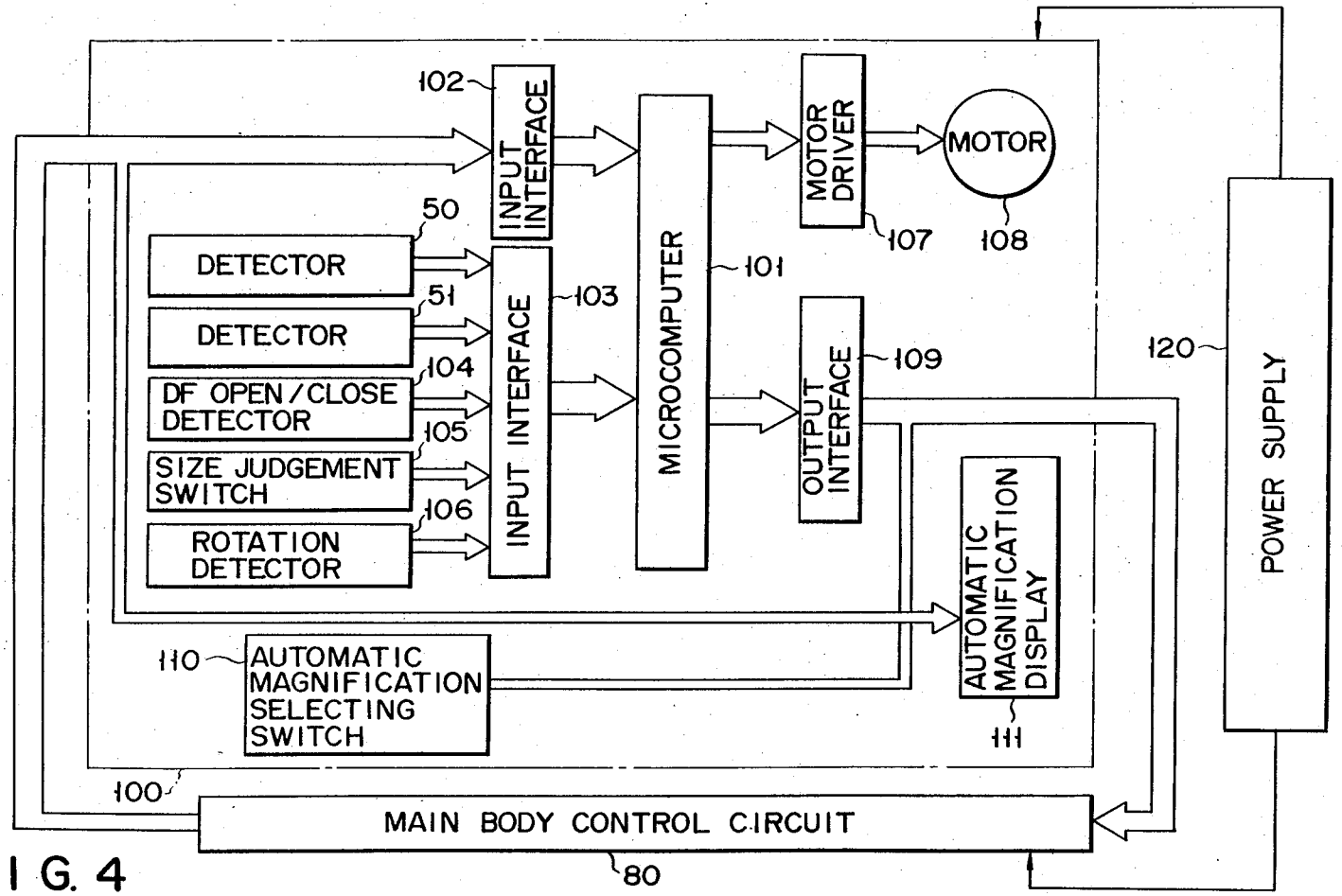
FIG. 4 shows a block diagram of a control circuit for controlling the operation of a document feeder of the copy machine of FIG. 1.

FIG. 4 shows, in block form, the DF control circuit 100 assembled into a printed circuit board. A microcomputer 101 serves as a main controller to control the overall document feeder 30. The microcomputer 101 is connected to the main body control circuit 80 through an input interface 102. The microcomputer 101 is further connected through an input interface 103 to the detectors 50 and 51, a DF open/close detector 104, a size check switch 105, a turn detector 106, and the like. The detector 104 detects the ON or OFF state of the document feeder 30. The size check switch 105 checks the width of the document D set on the document table 2 by detecting the positions of the document guides 33 and 33. The turn detector 106 detects the turn of a motor 108 by detecting the degree to which a timing disc has turned, the turn amount being proportional to the turn of the motor 108. The turn detector 106 then produces pulses corresponding in number to the amount the disc has turned.

The microcomputer 101 then sends a control signal to the motor 108 through the motor driver 107. The motor 108 is provided for driving, for example, the turn rollers 36 and 42, and the feed rollers 47 to 49. The microcomputer 101 further sends a signal to the main body control circuit 80 through the output interface 109. Also, the automatic magnification select switch 110 sends a signal to the main body control circuit. The main body control circuit 80 products a signal representing the magnification selection state of the auto select mode, as selected by the automatic magnification select switch 110, and sends it to the automatic magnification indicator 111. The automatic magnification select switch 110 and the automatic magnification indicator 111 are provided at predetermined locations on, for example, the housing 31 of the document feeder 30.

In FIGS. 3 and 4, a power source section 120 is used in common for both of the main body control circuit 80 and the DF control circuit 100. The microcomputer in each control circuit supervises the control operation of the other control circuit in a manner such that when the main body control circuit 80 is operating, that is, when the main body 1 of the copy machine is operating, the DF control circuit 100 is not operated, and such that when the DF control circuit 100 is operating, that is, when the feeder 30 is operating, the main body control circuit 80 is not operated except for a minimum time required for the copy machine 1 to prepare for its copying operation, viz. the warming up period. Therefore, it is required that the power source section supply only a necessary amount of power to only one of the control circuits 80 and 100 for one period. Therefore, the required power capacity is not the sum of the power necessary for driving both the control circuits, but the power required of one of the control circuits which is larger than that of the other control circuit (in this case, the main body control circuit 80).

Figure 5A:
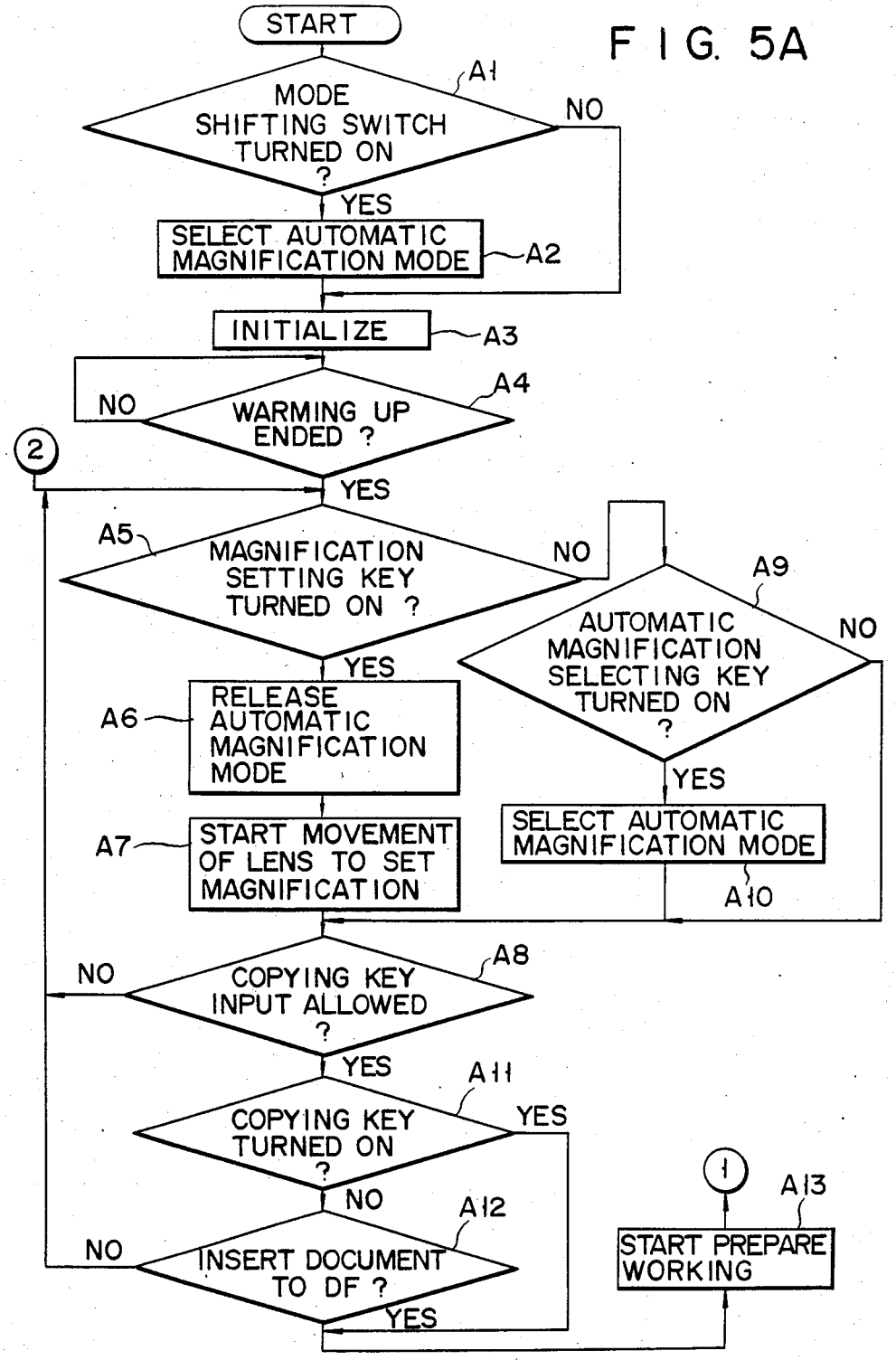
FIGS. 5A and 5B show flowcharts useful in explaining the operation of the main body of the copy machine.
Figure 5B:
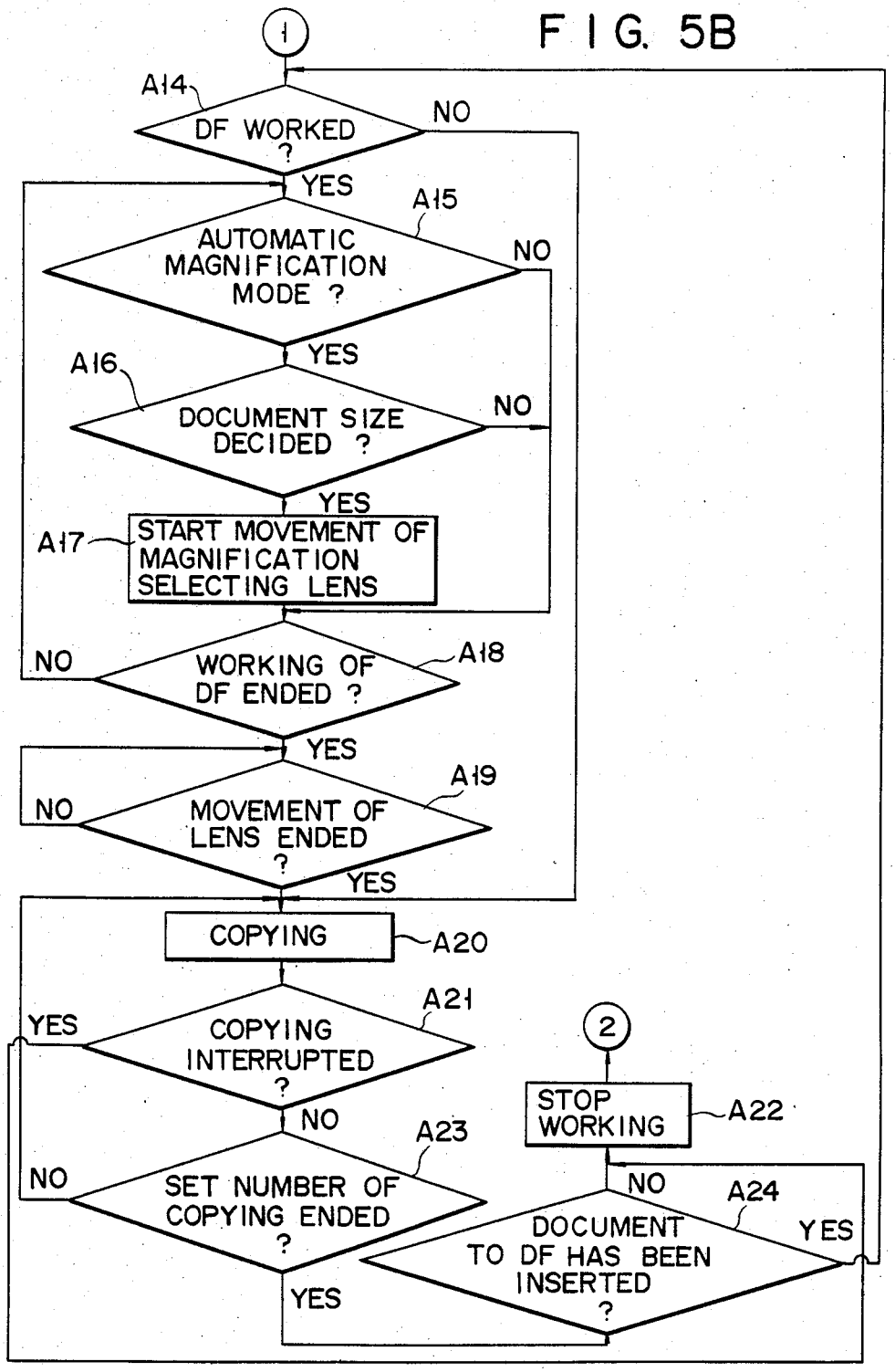
Figure 6A:
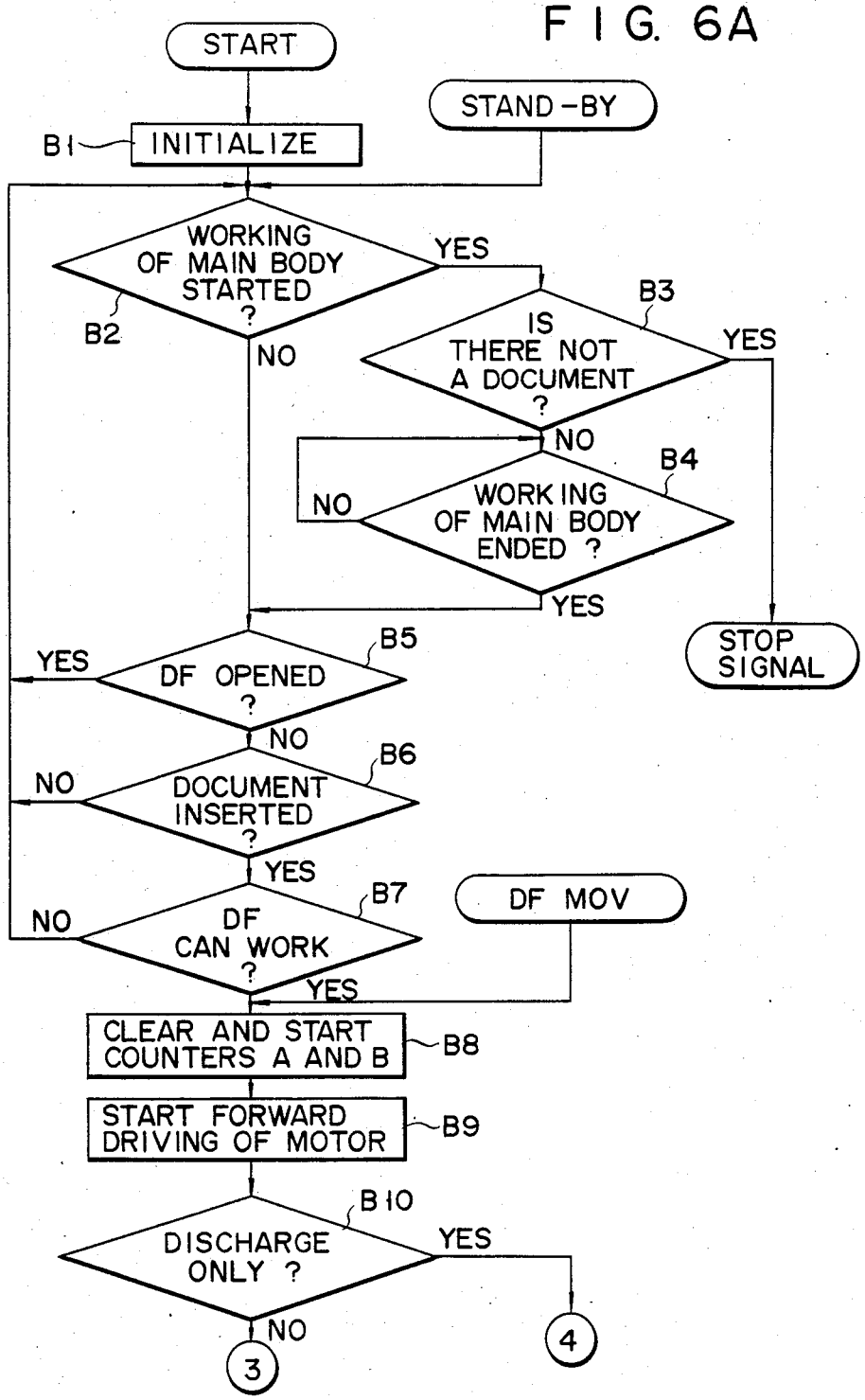
Figures 1, 6B:
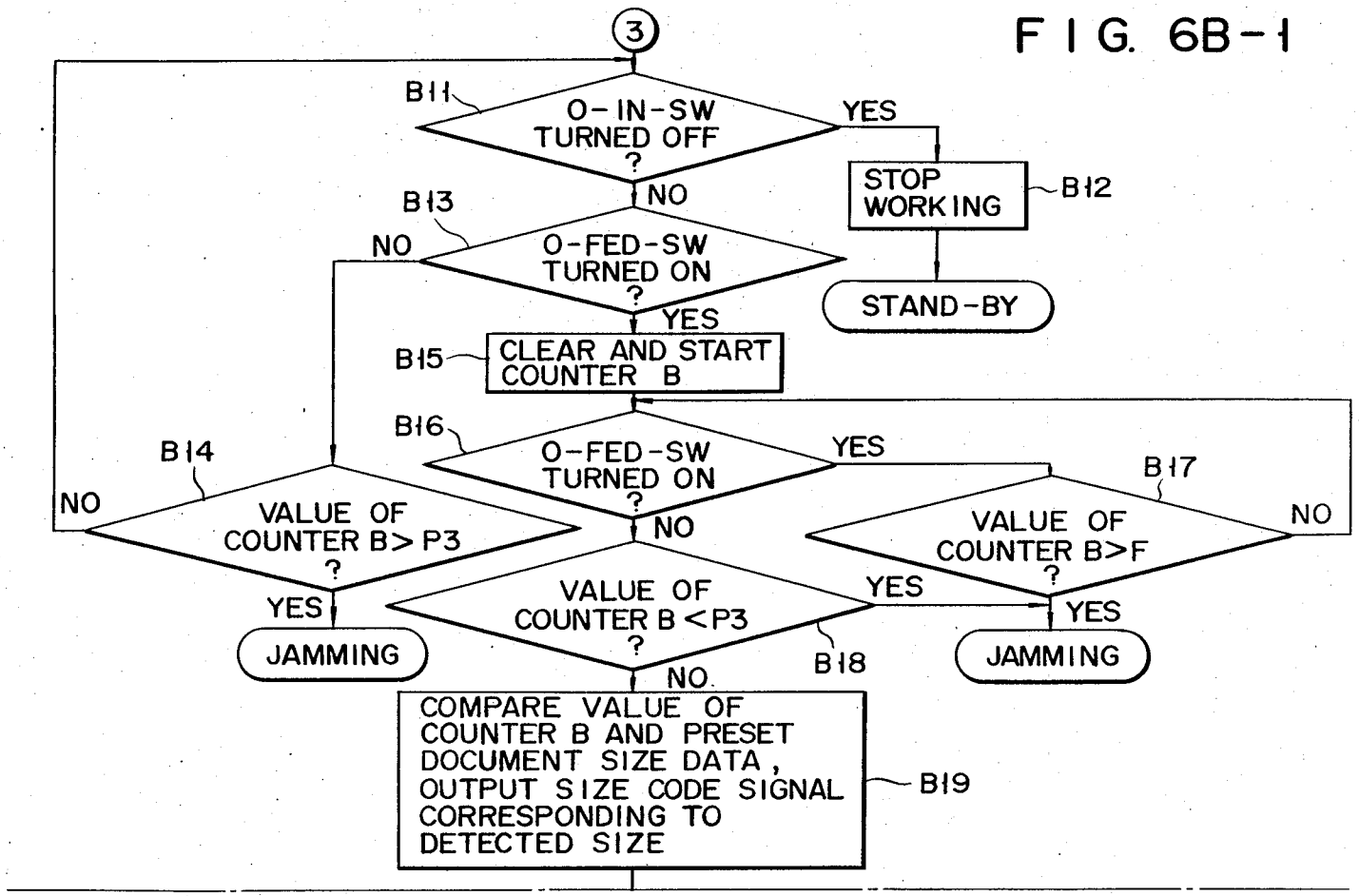
Figures 2, 6B:
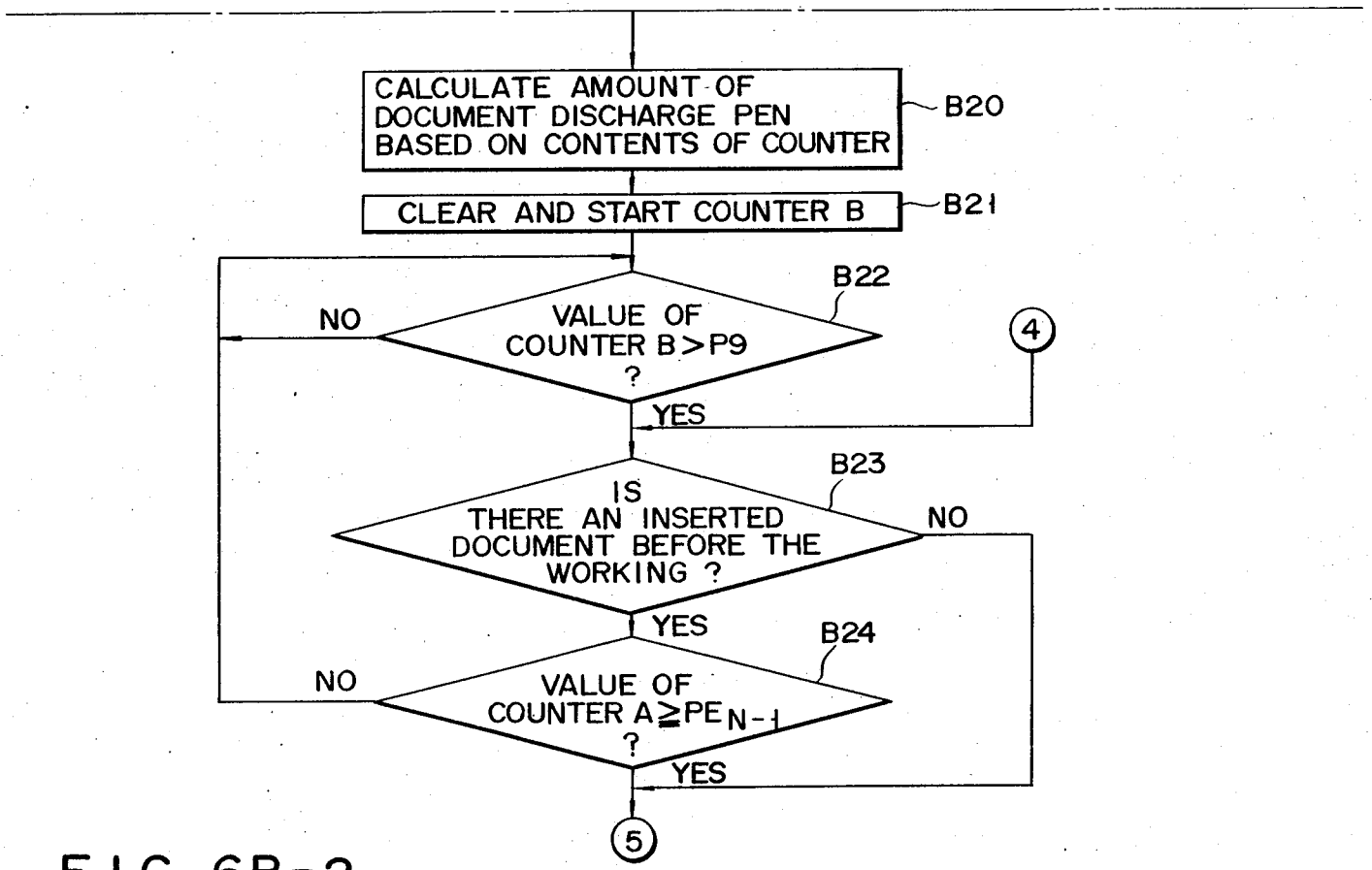
Figure 6C:
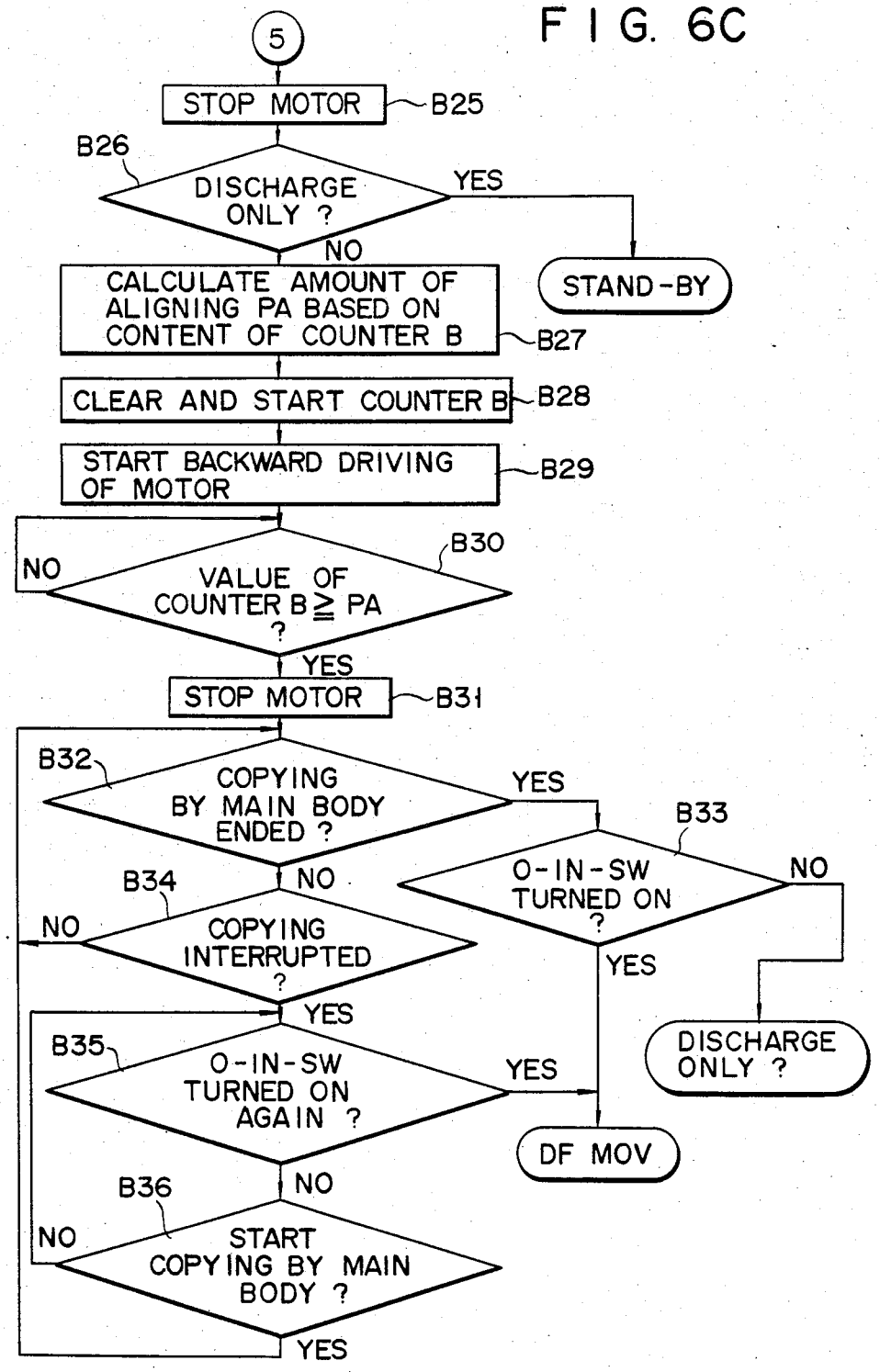

Bearing in mind the above fact, the operation of both the copy machine and the paper feeder will be described. The operation of the copy machine in the main body 1 will be given first with reference to the flowchart shown in FIGS. 5A and 5B. This operation is under the control of a program stored in a ROM contained in the microcomputer 81. In step A1, it is checked whether the switch 84 is set in the ON position.

If it is in the ON position, step A2 is priority executed and a control necessary for the auto select mode, which will be described later. If it is not in the ON position, the microcomputer 81 advances directly to step A3. In this step, initializing is done to, for example, operate the lens motor 89 so that the magnification will be set at 100%. Then, the microcomputer 81 advances to step A4. In this step, it is checked whether or not the heat roller 19 has been heated to the fusing temperature; that is, whether the warming up period has ended. If the answer is yes, step A5 is executed. This step is for checking whether the magnification set key is turned on or not. If it is turned on, the next step, step A6, is executed. In step A6, the auto select mode is removed and a turn-off signal is sent to the auto select indicator 111. Step A7 is then executed. In this step, the lens motor 89 is operated to move the lens 27 so as to obtain the desired magnification. Then, step A8 is executed.

When the magnification select key 72 is not turned on in step A5, the microcomputer 81 executes step A9. In step A9, the microcomputer 81 decides if the automatic magnification select switch 110 is turned on. If yes, step A10 is executed to select the auto select mode. Then, step A8 is executed. If the auto mag select switch 100 is not turned on, the microcomputer 81 skips step A10 and returns to step A8. In step A8, the microcomputer 81 checks whether actuation of the start key 61 is acceptable or not. At this time, for example, if the cassette containing the paper P1 is empty, or another magnification is being selected upon pushing of the magnification select key 72, the operation of the start key 61 is unacceptable. Under this acceptable condition, if the microcomputer 81 decides, in step A12, that the start key 61 has been turned on or the document D has been inserted into the document feeder 30 (designated as simply DF in the flowchart), in response to the signal from the first detector 50, it advances to step A13, thereby to allow for preparation of the copying operation or the document feed, which will be described in detail later. During the sequential operation from steps A8 to A12, the setting of a plurality of copies is done.

In step A13 the preparation operation starts. Then, step A14 is executed to decide if the start of the operation of the document feeder 30 is allowed. This step is used when, in steps A12 and A24 (to be given later), it is decided that the document D has been inserted into the document feeder 30. More specifically, when the document D is inserted into the document feeder 30, the document feeder 30 starts its operation, only, however, when the main body control circuit 80 decides that the operation of the document feeder 30 is allowed. From this, it can be inferred that when the document feeder 30 does not start its operation, an operation mode (as set by the start key 61) not using the document feeder 30 has been set up. Therefore, the microcomputer 101 advances to step A20.

In step A15 it is decided whether or not the auto select mode of magnification has been selected. If yes, step A16 is executed. This step is for checking if a signal representing the size of the document D has arrived from the DF control circuit 100. If yes, step A17 is executed. In this step, a magnification appropriate to the paper size is selected on the basis of the decision by the DF control circuit 100, and the lens 27 is moved correspondingly. The steps A15 and A16 are repeated until, in step A18, the microcomputer 101 registers the completion of the operation of the document feeder 30. This being the case, the magnification is selected at the same time as the paper size is picked up.

When the operation of the document feeder 30 ends, if the auto select mode causes the lens 27 to move, the microcomputer 101 waits, in step A19, until the movement of the lens is completed. Upon the end of the lens movement, step A20 is executed so that the copying operation is performed in the case where the document feeder 30 is not used. In the next step A21, it is determined if the copying operation has been interrupted by, for example, operating a stop key. If the answer is yes, step A22 is executed. In this step, the microcomputer 101 stops the copying operation and returns its control to step A5. If the answer is no, the copying operation continues until, in step A23, microcomputer 101 registers the end of the copying operation on a plurality of copies. If the answer in step A23 is yes, the microcomputer performs step A24. In this step, it is checked whether or not the next document D to be copied is set in the document feeder 30. If yes, step A14 is reexecuted. When the next document D is set in the document feeder 30, the document feeder 30 must operate for the next copy immediately after the previous copying operation ends. To realize this, the sequence of the steps up to step A13, which is for the preparation operation of copy, must be omitted, resulting in a saving of the copying time. It is for this reason that the control of the microcomputer 101 returns to step 14.

By the control as mentioned above, during operation of the document feeder 30, the copy machine in the main body 1, except for its partial operation (for example, the warming up of the machine) is not operated, as seen from steps A14 and A18.

The operation of the document feeder 30 will be described referring to the flowcharts shown in FIGS. 6A, 6B-1, 6B-2 and 6C. This control is executed by a program stored in a read only memory (ROM) of the microcomputer 101. In step B1, an initializing necessary for the control of the document feed is made. Then, control enters a stand-by subroutine from steps B2 to B7. In this routine, the microcomputer 101 checks as to whether on not the main body 1 of the copy machine (referred to simply as the "main body" in the flowcharts) begins operating (by the start key 61) without regard to the document feeder 30 (step B2). When the main body begins operating, the microcomputer 101 goes to step B3. In the previous copying operation using the document feeder 30, the document feeder 30 is not opened or closed after the document D is discharged. On this basis, it can be concluded that no document D has been set.

In such a case, the microcomputer 101 produces a stop signal (or a jam signal) to stop the main body 1 (step B3). If the document D has been set, control goes to step B4 and the microcomputer 101 waits until the operation of the main body is completed. When the main body 1 operates independent of the document feeder 30, the document feeder 30 does not operate. As already described, the main body 1 does not function, except for the warming up period, when the document feeder 30 is working. Thus, the main body 1 and the document feeder 30 are, for the most part, alternately operated.

When the main body 1 is not operated, control proceeds to step B5. In this step, determination is made by the microcomputer 101 as to whether or not the document feeder 30 has been opened by the signal from the DF open/close detector 104. If it has been opened, control is returned to step B2 so as to inhibit the operation of the document feeder 30. If it is closed, control goes to step B6. In this step, a decision is made as to whether the document D has been inserted (the first detector 50 is turned on). If yes, step B7 is executed. If no, control is returned to step B2. In step B7, the microcomputer 101 decides whether or not operation of the document feeder 30 is permissable, in response to the signal from the main body control circuit 80. If yes, step B8 is executed.

A sequence of steps B8 to B31 controls the setting and discharge of the document D. Counters A and B, which are used in the control to be given below, will now be described. These counters are hardware counters contained in the microcomputer 101, and operate in response to the leading edge of a pulse derived from the turn detector 106. In step B8, both the counters A and B are cleared, and then, the copying operation is started. In the next step, B9, the motor 108 is forwardly rotated (in a direction by which to pull the document D in), and then control is advanced to step B10. In step B10, a decision is made as to whether the only discharge operation has been performed. If the answer is yes, control jumps to step B23. If the document D is set, step B11 is executed.

The steps B11 to B14 which are to be executed are provided for checking if the document D has been appropriately transferred and has reached the second detector 51. In step B11, a decision is made as to whether the first detector 50 (denoted as O-IN-SW in the flowchart) is turned off till the document D reaches the second detector 51 (denoted as O-FEED-SW in the flowchart). If yes, the document D was pulled out somewhere in its path. In this case, control advances to step B12 where the working of the document feeder 30 is stopped, and control is returned to the stand-by routine. In step B13, a decision is made as to whether the second detector 51 has been turned off. In step B14, a decision is made as to whether the motor 108 has turned sufficiently to cause the document D to reach the second detector 51, while the second detector 51 is shut off. (Incidentally, in such a turn amount, the counted value of the counter B is Pl.) If yes, the transfer of the document D is abnormal, that is, jamming has occurred. If the decision in step B13 is such that the document D has been transported normally, and that the second detector 51 is turned on, the next step, B15, is executed.

Steps B15 to B18 are executed to determine the length of the document D. More specifically, the counter B detects how many times the motor 108 rotates as long as the detector 51 is on. In step B15, the counter B is cleared and restarted. In step B16, decision is made as to whether or not the detector 51 has been turned on by the presence of the document D. If yes, the flow goes to step B17. If no, it goes to step B18.

In step B17, the count of the counter B is compared with a second value P2. Value P2 is slightly greater than the value the counter 51 has when it is turned off, if the longest document that can be copied by this apparatus is correctly transporated. Hence, when the count of the counter B is greater than value P2, the document D is either too long or has not been correctly transported. In this case, the microcomputer 101 decides that jamming has occurred.

In step B18, the count of the counter B is compared with a third value P3. Value P3 is slightly less than the value the counter 51 has when it is turned off, if the shortest document that can be copied by this apparatus is correctly transported. Hence, when the count of the counter B is less than value P3, the document P is either too short or has not been correctly transported. In this case, too, the microcomputer 101 decides that jamming has occurred.

In this way, a document larger or smaller than the maximum or minimum sized document is removed and the microcomputer 101 advances to step B19. In the step B19, the length of the document D, which was obtained from the counted value of the counter B, is compared with the document size data stored in the ROM in the microcomputer 101. The size of the document D is checked on the basis of the ON and OFF states of the size check switch 105 for detecting the width of the document D. A code signal representing the obtained size of the document D is applied, as the size data of the document D to be copied, to the main body control circuit 80. By sending the signal representing the document size thus obtained to the main body control circuit 80 at the first timing the main body control circuit 80 reads in the code signal, the main body control circuit 80 can then obtain second the timing to select a magnification if the auto select mode is set up. Further, the amount of transportation necessary for the discharge of the document D can be determined from the length of the document D. This value $PE_N$ (N is the document number) is calculated (step B20) and stored into the RAM of the microcomputer 101.

In the next step, B21, the counter B is cleared and restarted. The microcomputer 101 then executes step B22. In this step, decision is made as to whether or not the count of the counter B is greater than nine. If yes, the document D is considered to have moved from the detector 51 to the position where its trailing edge is closer to the discharge side than the stopper 29.

The next two steps B23 and B24, are executed to discharge the document D. In step B23, decision is made as to whether or not any other document has been inserted before the document D is discharged. If no, that is, if another document is inserted after the document D has been discharged, step B25 is performed, thus stopping the motor 108. If yes, step B24 is executed.

In step B24, the count of the counter A is greater than or equal to value $PE_{N-1}$, where $N-1$ is the number of the document inserted before document D. Value $PE_{N-1}$ is the distance over which the document D must be transported before being discharged. The counter counts the rotations of the motor 108, this detecting the distance over which the document D has been transported after the motor 108 has started its forward rotation. If the distance, sequired for discharge is detected, the next step, B25, is carried out, thereby stopping the motor 108. If no such distance in detected, the document D is not considered to have been discharged, and steps B22 and B23 are repeated, thus continously rotating the motor 108 until the count of the counter A reaches value $PE_{N-1}$.

When the count of the counter A reaches value $PE_{N-1}$ and the motor 108 is thus stopped, the new document is regarded as having reached a position closer to the discharge side than the stopper 29.

In the next step, B26, decision is made as to whether or not the document D should be discharged, since no new document has been inserted. If yes, the control procedure returns to the stand-by routine. If no, the procedure advances to step B27.

In step B27, the microcomputer 101 calculates the distance the new document D must cover to each the position where its trailing edge is aligned with the stopper 29, from the count of the counter B, the count of which represents the distance which the new document D has covered until the motor 108 stops. The count PA of the counter B, which corresponds to the calculated distance, is stored in the RAM provided within the microcomputer 101.

In a step B28, the counter B is cleared and restrated. Then, in step B29, the motor 108 is rotated reversely, i.e. in the direction to feed the document D toward the stopper 29. In the next step, B30, the motor 108 is rotated until the count of the counter B exceeds PA. When it exceeds PA, the motor 108 is stopped in the next step, B31. The document feeder 30 sets the new document D. (When the new document D is set, the control returns to step A18 and then to step A19, whereby the copying is started in the main body 1.)

Steps B32 to B36 executed to determine how the document feeder 30 operates when the copying is interrupted in the main body 1. First, in step B32, decision is made as to whether or not the desired number of copies have been obtained. If yes, the control procedure advances to step B33. If no, it goes to step B34.

In step B33, it is determined whether or not the detector 50 is on. If yes, the next document D is considered to have been inserted, and the control procedure goes to the motor-driving routine that starts with step B8. If no, the first document D is discharged and the procedure advances to step B8.

In step B34, decision is made as to whether or not the copying has been interrupted in the main body 1. If yes, the procedure goes to the next step, B35. If no, step B32 is repeated, whereby the microcomputer 101 waits for the resumption of copying. In step B35, it is judged whether or not the detector 50 has been turned on. If yes, the control procedure goes to the motor-driving routine starts with step B8. If no, it advances to step B36.

In step B36, decision is made as to whether or not copying has started by operating the start key 61. If yes, the procedure returns to step B32. If no, it returns to step B35.

As described above, in the auto select mode the size of the document D set on the table 2 is detected by the document feeder 30, and a magnification appropriate to the paper size (e.g. A4-R) is automatically determined from the detected document size. Then, copying is started. The auto select mode is not selected unless the document feeder 30 is used. When the magnification is selected by operating the magnification select key 72, the auto select mode is automatically cancelled, and the manual select mode usually used is selected. Additionally, when no action occurs in the copy machine for a predetermined time (e.g. 30 seconds), control automatically returns to the initial state, and the auto select mode is automatically selected.

The relationship among decisions made concerning document sizes, magnifications selected as a result of the decisions, and the related items is shown in the following table, prepared for the paper size of A4-R.

| Document size | Size check switch | Length of document (mm) | Code signal | Magnification (%) |
|---|---|---|---|---|
| B6-R | OFF | ~196 | 3 | 122 |

-continued

| Document size | Size check switch | Length of document (mm) | Code signal | Magnification (%) |
|---|---|---|---|---|
| B5 | ON | ~196 | 2 | 82 |
| A5-R | OFF | 196~233 | 1 | 122 |
| B5-R | OFF | 233~283.5 | 5 | 115 |
| A4-R | ON | 283.5~310.5 | 7 | 100 |
| B4 | ON | 341.5~392 | C | 82 |
| A3 | ON | 392~ | E | 71 |

As can be understood from the foregoing, in the image forming apparatus of the present invention, the document size is automatically detected, and a magnification appropriate to the size of the paper as set in the cassette is automatically selected in accordance with the detected document size. Thus, the present invention has successfully solved the problems of the prior art; i.e., erroneous copying and the attendant waste of paper. Further, the operability of the copy machine is remarkably improved. Many other useful advantages can also be attained.

In the above-mentioned embodiment, the present invention is applied to a copy machine of the document moving type in which the document table is moved relative to the fixed optical system. It is evident that the present invention is also applicable to a copy machine of the type in which the optical system is moved relative to the fixed document table. Further, the present invention is applicable to a copy machine not provided with a document feeder, although the copy machine used to exemplify this invention is provided with a document feeder. What is more, the present invention is applicable not only to a copy machine, but also to any other image forming apparatus such as electronic printers and printing machines.

As seen from the foregoing, in the image forming apparatus of the present invention, the document feeder is operated only when the image forming body is not operated. Therefore, the present invention can provide a small, light weight and inexpensive image forming apparatus requiring neither an increased power capacity for the power supply to the image forming body, or additional, and, more precisely, simutaneous use of the power supply for a document feeder.

What is claimed is:

1. An image forming apparatus with an automatic document feeder, said apparatus comprising:

a document table;

an image forming body unit comprising optical means for optically scanning a document on said document table to be copied to obtain a document image, image forming means for forming said document image from said optical means on to an image formation medium, and fixing means for fixing said document image which has been formed by said image forming means on said image formation medium;

an automatic document feeder comprising an insertion section provided to cover said document table and through which said document to be copied is inserted, first conveying means for conveying said inserted document to a predetermined position on said document table, discharging means for discharging said document which has been conveyed by said first conveying means, second conveying means for conveying said document from said predetermined position to said discharging means, first detector means for detecting an insertion of the document to be copied through said insertion secton, and second detector means for detecting that said document is conveyed by said first conveying means to said predetermined position on said document table;

means for instructing an image formation;

first control means, responsive to an instruction from said image formation instructing means, for supplying a first sequence control signal necessary for an image formation operation to said image forming body unit, and for simultaneously generating a first wait instruction signal for commanding said automatic document feeder to a wait state during the image formation operation;

second control means, responsive to one of (a) said detection signals from said first and second detector means, and (b) said first wait instruction signal from said first control means, for producing a second sequence control signal necessary for one of (a) a document conveying operation and (a) said wait state to a respective associated means of said automatic document feeder, and for generating, during said document conveying operation, a second wait instruction signal for setting a respective means, other than said fixing means of said image forming body unit, in a wait state; and power source means having a single power source shared between said image forming body unit and said automatic document feeder.

2. An image forming apparatus according to claim 1, wherein when said image forming body unit completes said image formation operation in relation to said document conveyed by said automatic document feeder to said predetermined position on said document table, an insertion of a next document is detected to cause said detection signal from said first detector means, said second control means generating a start signal for immediately starting the image formation operation of said image forming body unit without awaiting an instruction from said image formation instruction means when said detection signal is produced.

3. An image forming apparatus according to claim 1, wherein said automatic document feeder is openable and closable relative to the document table and includes third detector means for detecting a state in which said automaitc document feeder is opened or closed relative to said document table, and said first and second control means are also for generating a third wait instruction signal for setting said image forming body unit and said automatic document feeder in said wait state when said third detector means detects said opening of said automatic document feeder.

4. An image forming apparatus according to claim 3, wherein, when said third detector means detects said closed state of said automatic document feeder, and at the same time there are no detection signals from said first and second detector means, after said document has been conveyed by said second conveying means of said automatic document feeder from said predetermined position on said dicument table to said discharging section, said second control means judges that the next document is not set at said predetermined position on said document table and generates a fouth wait instruction signal for setting said image forming body unit in said wait state.

* * * * *